US007490386B2

(12) United States Patent
Raccosta

(10) Patent No.: US 7,490,386 B2
(45) Date of Patent: Feb. 17, 2009

(54) CHROMATIC SNAP FASTENER

(76) Inventor: Gaetano Raccosta, Via Petrarca, 5, I-23807 Merate (LECCO) (IT)

( * ) Notice: Subject to any disclaimer, the term of this patent is extended or adjusted under 35 U.S.C. 154(b) by 415 days.

(21) Appl. No.: 11/193,011

(22) Filed: Jul. 28, 2005

(65) Prior Publication Data

US 2006/0021198 A1 Feb. 2, 2006

(30) Foreign Application Priority Data

Jul. 29, 2004 (IT) ..... MI2004U0368

(51) Int. Cl.
*A44B 1/04* (2006.01)

(52) U.S. Cl. ..... 24/114.9; 24/108; 24/114.12

(58) Field of Classification Search ..... None
See application file for complete search history.

(56) References Cited

U.S. PATENT DOCUMENTS 707,054 A * 8/1902 Dowse ..... 24/681

* cited by examiner

*Primary Examiner*—Jack W. Lavinder
(74) *Attorney, Agent, or Firm*—James V. Costigan; Hedman & Costigan, P.C.

(57) ABSTRACT

A snap fastener comprises a female part to be clamped on a first flap, for example of the fabric material, and a male part, to be clamped on another flap of the fabric material, in which the female part comprises an active element and a clamping element, the active element and clamping element having different surface finishings. Moreover, through the exposed to view part of the active female element are provided a plurality of openings, having different configurations, therethrough it is possible to see the top surface of the clamping element.

With respect to prior snap fasteners, the inventive snap fastener has the advantage of providing chromatic effects, which can be easily obtained at the female part of the pushbutton.

3 Claims, 5 Drawing Sheets

CHROMATIC SNAP FASTENER

BACKGROUND OF THE INVENTION

The present invention relates to a novel snap fastener providing a particular aesthetic effect.

The field of the invention is that of snap fasteners used for mutually clamping two flaps of fabric or other material.

As is known, snap fasteners conventionally comprise a male part clamped on a first flap to be coupled and a female part clamped to another flap.

Each said part is in turn constituted by an active element and a clamping element for clamping the active element to the fabric flap.

Since the snap fastener is applied at an exposed to view position, it can constitute, in addition to a fitting having desired functional properties, also an element affecting the aesthetic aspect of the cloth article to which said snap fastener is applied.

Thus, colored snap fasteners or snap fasteners having integrated therein ornamental patterns are commercially available.

However, the provision of the mentioned aesthetic effects on prior snap fasteners is made very complex by existing difficulties in forming desired patterns or color contrasts on the surface, usually very small, of said prior snap fasteners.

SUMMARY OF THE INVENTION

Accordingly, the main object of the present invention is to provide such a snap fastener which comprises, in particular on the surface of its female element or part, chromatic effects which can be easily made.

The above mentioned as well as yet other objects are achieved by a snap fastener according to claim 1.

Preferred embodiments of the inventive snap fasteners are defined in the dependent claims.

With respect to prior snap fasteners, the inventive snap fastener provides the advantage that it comprises chromatic effects which can be easily made at the female part of the snap fastener.

BRIEF DESCRIPTION OF THE DRAWINGS

The above mentioned objects, advantages and characteristics of the inventive snap fastener will become more apparent hereinafter from the following disclosure of some preferred embodiments thereof which are illustrated, by way of an indicative, but not limitative, example in the figures of the accompanying drawings, where.

DESCRIPTION OF THE PREFERRED EMBODIMENTS

Figure 1:
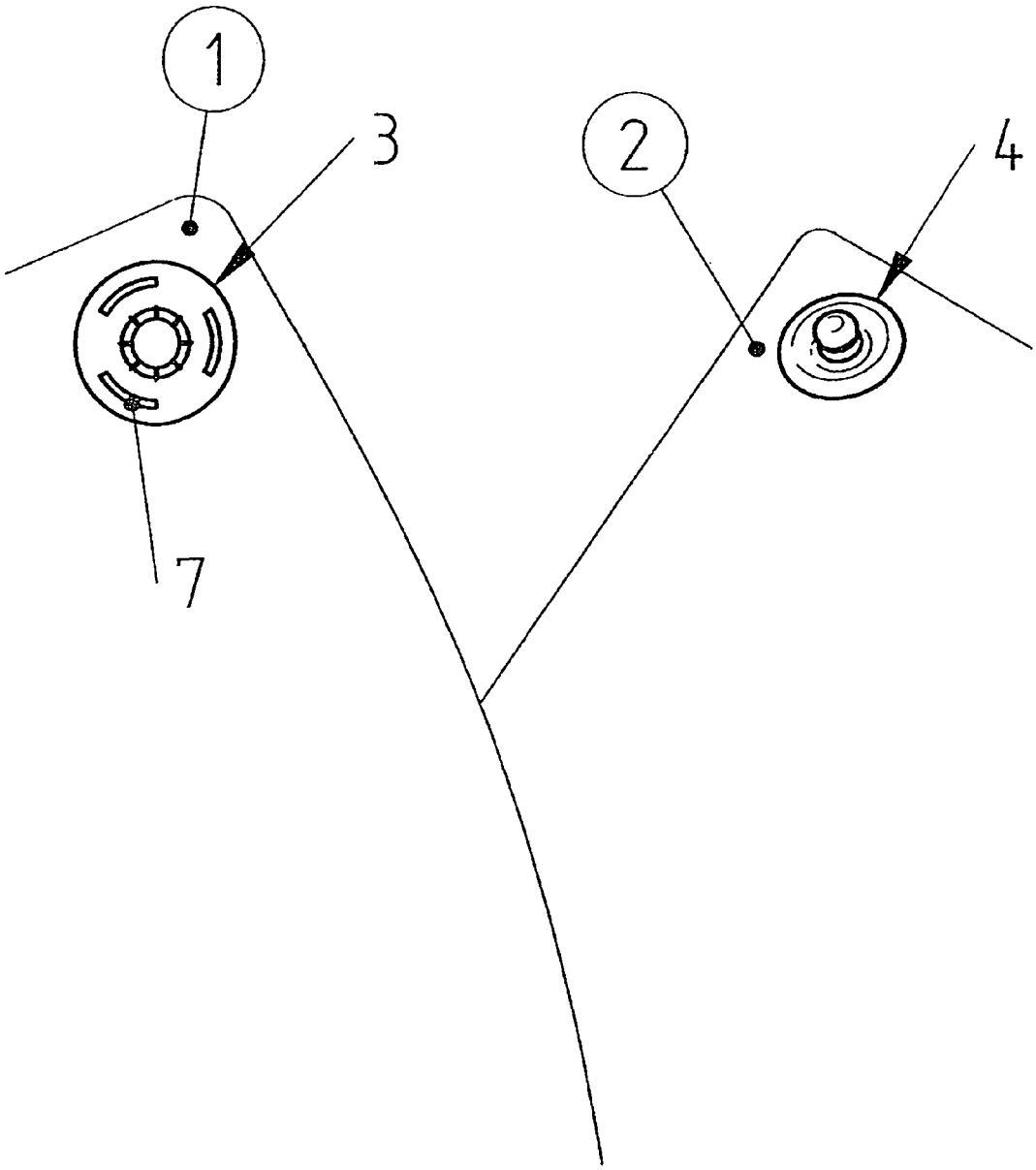
FIG. 1 shows two fabric flaps to be coupled by the snap fastener according to the present invention.

The snap fastener according to the present invention has been shown in FIG. 1.

Said snap fastener comprises a female element or part 3 clamped on a first flap 1, for example of a fabric material, and a male element or part 4, clamped on the other fabric flap 2.

Figure 2:
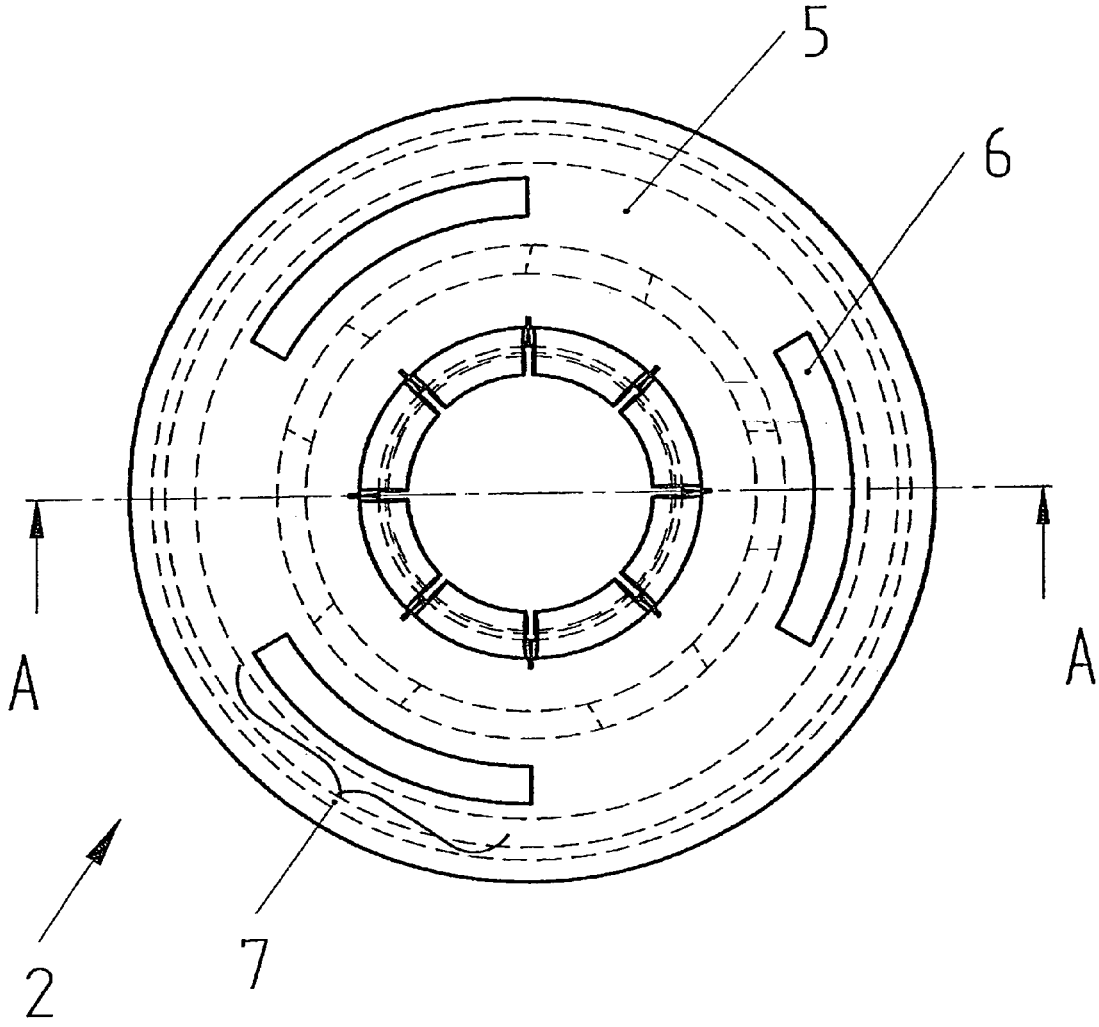
FIG. 2 is a top plan view showing the configuration or pattern of the active female part or element of the snap fastener according to the invention.
Figure 3:
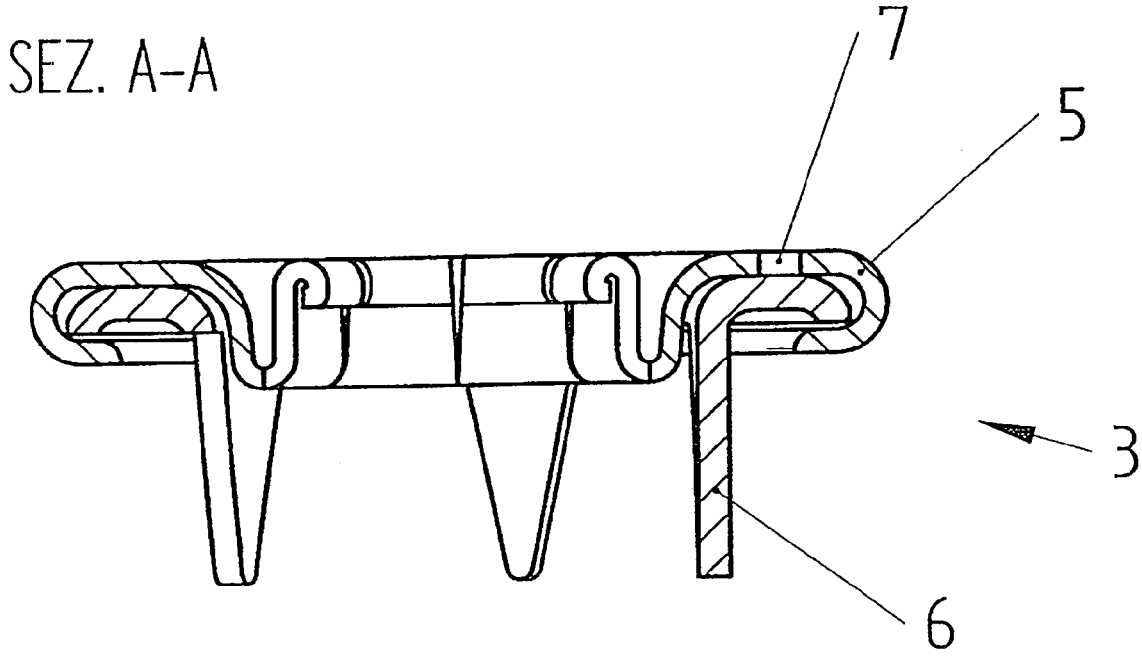
FIG. 3 is a cross-sectional view illustrating the female element or part shown in FIG. 2.
Figure 4:
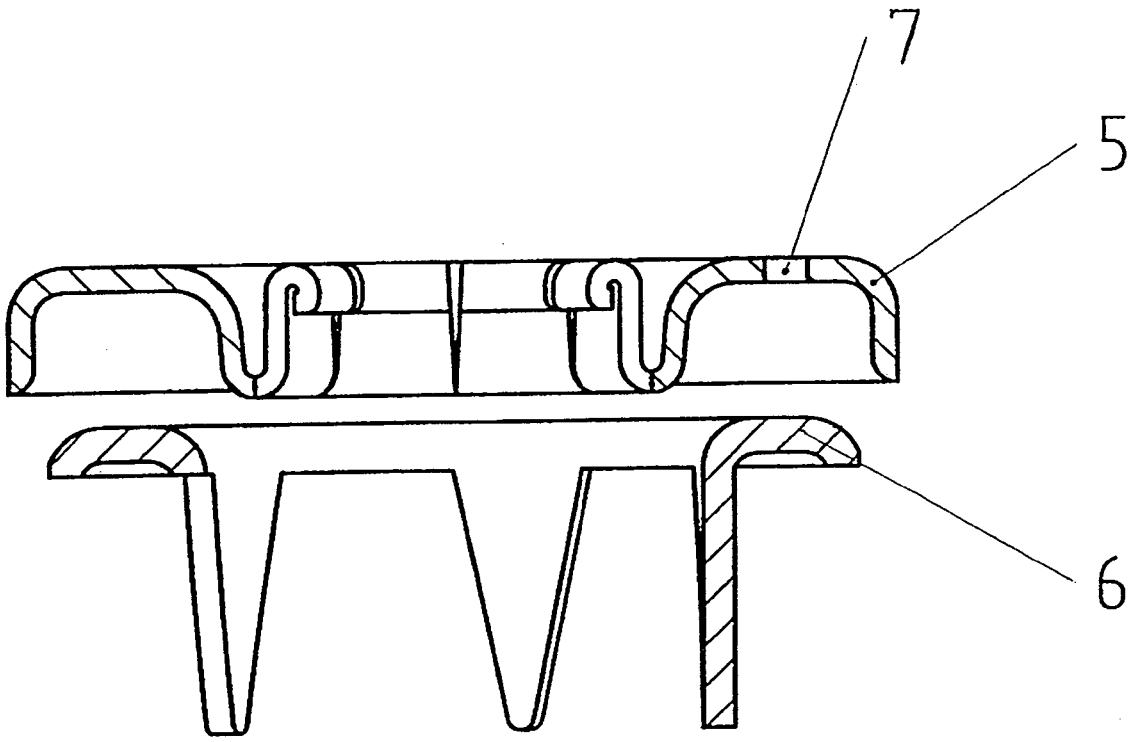
FIG. 4 is a further exploded cross-sectional view illustrating the female part shown in FIGS. 2 and 3.

The female part 3, shown in FIGS. 2 to 4, comprises an active element 5 and a clamping element 6 which is in turn constituted by a clip element locked on the active element 5.

Said active element 5 comprises a plurality of resilient wings 8 arranged with a ring-like pattern, engaging with a projecting part 10 of the active male element 9.

Figure 5:
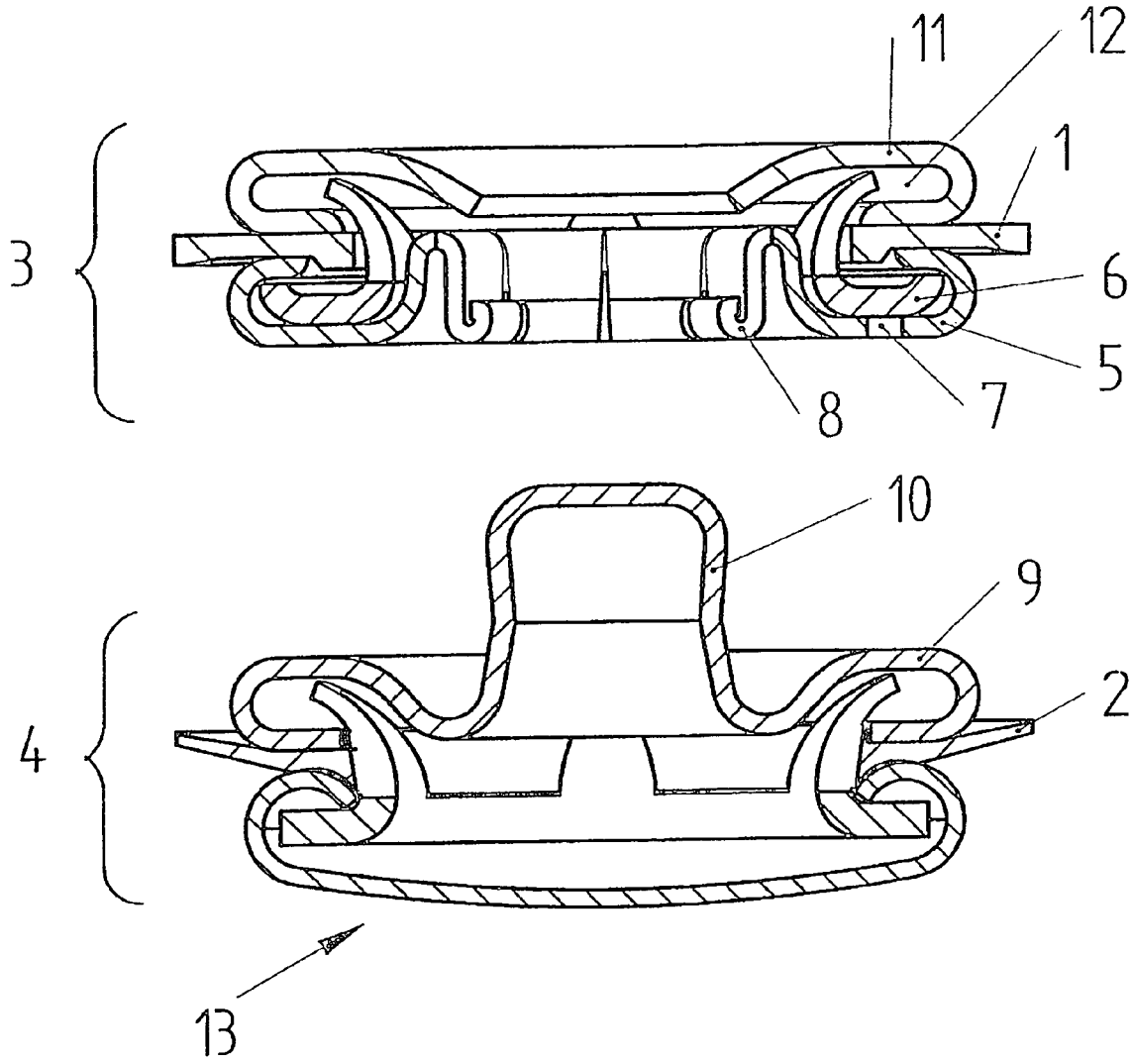
FIG. 5 shows the male and female elements of the snap fastener according to the invention.

The active female element 5, bearing said clamping element 6, is anchored to the fabric flap 1 by deforming said clip element inside a groove 12 of a cap element 11 (FIG. 5).

The active male element 9 is in turn locked to the fabric flap by a clamping male element 13.

The two elements 5 and 6 forming the female part 3 can be finished with different surface finishings.

To that end, by providing a plurality of openings, of any desired configurations, through the exposed to view part of the active female element 5, it is possible to see, through said openings, the top surface of the clamping element 6 of the snap fastener female part 3, which will be suitably colored in a contrasting manner with respect to the corresponding exposed to view surface of said active female element 5 (FIGS. 1 and 2).

This contrast effect can be obtained by two different surface processings of said elements 5 and 6, which could comprise an application of different colors or phosphorescent or light emitting products in general.

The invention claimed is:

1. A snap fastener comprising a female part to be clamped on a first flap of a fabric material, and a male part to be clamped on another flap of said fabric material, said female part comprising an active element and a clamping element, wherein said clamping element of said female part comprises a clip of elements lockable on said active element of said female part, said active element of said female part comprising a plurality of resilient wings arranged with an annular arrangement and snap engaging with a projection of said male part, said active element of said female part having a visible top surface, said clamping element of said female part having a top surface, said active element of said female part including a plurality of throughgoing openings allowing said top surface of said clamping element of said female part to be seen, said active element and clamping element of said female part having different surface finishes.

2. A snap fastener according to claim 1, wherein said surface finishes of said active and clamping elements of said female part are colored in a contrasting manner from one another.

3. A snap fastener according to claim 1, wherein said surface finishes comprises phosphorescent finishes.

* * * * *